US005898645A

United States Patent [19]

Sugiyama

[11] Patent Number: 5,898,645

[45] Date of Patent: Apr. 27, 1999

[54] SOFTWARE-DRIVEN TIME MEASURING DEVICE

[76] Inventor: Akira Sugiyama, 27-102 Fujinokidai Danchi 3-1 Sugasenya Tama-ku, Kanagawa Pref., Kawasaki, Japan

[21] Appl. No.: 08/655,361

[22] Filed: May 24, 1996

[51] Int. Cl.[6] ..... G04C 19/00; G04B 19/22; G04B 19/24

[52] U.S. Cl. ..... 368/82; 368/21; 368/29; 368/239

[58] Field of Search ..... 368/15–19, 21, 368/28, 29, 79, 82–84, 93, 94, 223, 228, 239–242, 155, 156

[56] References Cited

U.S. PATENT DOCUMENTS

| | | | |
|---|---|---|---|
| 5,007,033 | 4/1991 | Kubota et al. | 368/21 |
| 5,023,849 | 6/1991 | Vaucher | 368/15 |
| 5,208,790 | 5/1993 | Sato | 368/15 |

FOREIGN PATENT DOCUMENTS

| | | | |
|---|---|---|---|
| 58-151579 | 9/1983 | Japan | 368/93 |
| 58-151580 | 9/1983 | Japan | 368/93 |

*Primary Examiner*—Vit W. Miska

*Attorney, Agent, or Firm*—Jacobson, Price, Holman & Stern, PLLC

[57] ABSTRACT

A time-keeping section is programmed in such a manner that a predetermined number of virtual particles are caused to reciprocatively move between two virtual space regions successively, and the time-keeping section can sequentially keep time with accuracy using, as a basic time unit, a time required for the predetermined number of virtual particles to make a single travel from one of the space regions to the other space region. With the time values yielded by the time-keeping section, it is allowed to accurately accumulate the basic time unit over a preset time period (e.g., time data for 1,000 years). By incorporating such a time measuring device in each selected computer, accurate common time can be set for shared use among computers connected in a network and also with a computer loaded in an artificial satellite operating far from the earth. In addition, communication among the computers and remote control of any of the computers can be performed very smoothly.

8 Claims, 12 Drawing Sheets

SOFTWARE-DRIVEN TIME MEASURING DEVICE

BACKGROUND OF THE INVENTION

1. Field of the Invention

The present invention relates to a software-driven time measuring device which is especially well suited for use in computer-containing control equipments involving accurate timing control, and in computer networks to manage operation timing among the computers, to set proper access time of the computers and to also permit shared use of the thus-set access time among the computers as needed.

2. Description of the Related Art

An atomic clock (cesium clock) is known at present as the most accurate time measuring device, which is accurate to one part in $10^8$ sec. Specifically, such an atomic clock defines, as one second, the duration of the natural resonance frequency of the cesium atom (9,192,631,770), and International Atomic Time is determined by the Bureau International de l'Heure (on the premises of the Paris Astronomical Observatory) by averaging the measured values of atomic clocks located throughout the world. The value of the second is thus managed today in accordance with the internationally determined atomic time, whereas the length of the day is managed in accordance with Universal Time. According to Universal Time, the hours of the day are numbered from 0 to 24, using as 0:00 p.m. (noon) a time point (southing time) when the sun crosses the Prime Meridian of longitude passing through the old Greenwich Observatory, England and using as 0:00 a.m. (midnight) a time point 12 hours before and after the southing time. The local standard time in each individual country of the world is set on the basis of a predetermined longitude passing through the country, and it is determined how many hours the local standard time is ahead or behind Universal time (Greenwich Mean Time). Specifically, Japan standard time is set, using as 0:00 p.m. a time point when the sun crosses Akashi Observatory (the 135th degree of east longitude). Further, in a large majority of the countries of the world, the Gregorian calendar is still used, in accordance with which each common year is set to have 365 days while every fourth year is set as a leap year having a total of 366 days. The Gregorian calendar was introduced on the basis of the fact that one revolution period of the earth relative to the sun (one solar year) is 365.2422 days, and it defines one year using its approximate value of 365.2425 days as one solar year.

However, the setting of the year and day based on the astronomical periods (such as the periods of the earth's revolution around the sun and rotation on its own axis) is not satisfactory, because the length of the day is somewhat changing due to the fact that the speed of the earth's rotation on its axis is not always constant by being influenced by fluctuations of the earth's axis and seasonal variations. In addition, because the speed of the earth's rotation on its axis has a tendency to slow down little by little, a slight difference arises between International Atomic Time constantly measured by the atomic clocks and Universal Time measured on the basis of the movements of heavenly bodies. This difference between the two times is currently compensated for by adding or removing one second (leap second) to or from the last minute on June 30 or December 31 in the year when it has exceeded 0.9 second.

The time management on the earth today is based on such Universal time and International Atomic Time, and various equipments existing on the earth, such as computer-containing control equipments involving accurate timing control, contain a time-keeping circuit (such as a quartz oscillator circuit), to which the current time (Universal Time) is input so as to perform timewise drive control of the equipments on the basis of time indicated by the time-keeping circuit.

In recent years, it has become necessary to remotely operate various control equipments loaded in a spacecraft operating off the earth's time space (such as a weather satellite moving around the earth and an interplanetary probe satellite), and to connect, in a network, computers located in various countries of the world so as to allow the computers to access information at predetermined timing. If, in such applications, time to be shared among the computers is set on the basis of Universal Time or the standard time of a specific country, a leap second occurring once in some years must be considered and proper access may not be guaranteed because it is unclear whether there exists a common time standard with another party's computer (e.g., whether a specific party's computer indicates the same time as the other party's computer). In view of this inconvenience, a variety of approaches have been proposed (e.g., in Japanese Patent Laid-open publication No. HEI 4-337943) to smooth the necessary time management, but they could not provide a satisfactory solution to the problem. Further, in the case of a spacecraft flying away from the earth to a far remote planet (such as the "Voyager" rocket searching Saturn), variations in gravitational field would cause "slowing of clocks" as referred to in Einstein's general theory of relativity even though a high-accuracy atomic clock is loaded in the spacecraft's computer. Namely, in a gravitational field far from the earth, electrons move more slowly and hence the frequency of radiated light becomes lower, so that the atomic clock measuring the frequency of light radiated from an atom (cesium atom) is unable to measure time accurately.

SUMMARY OF THE INVENTION

It is therefore an object of the present invention to provide a software-driven time measuring device which is capable of measuring time with maximized accuracy.

In order to accomplish the above-mentioned object, a software-driven time measuring device according to a first aspect of the present invention comprises a time-keeping means provided in a central processing unit of a computer and including two virtual space regions having a same shape and capacity and isolated from other space region, the two virtual space regions being interconnected for communication therebetween in such a manner that a predetermined number of virtual particles are caused to reciprocatively move between the space regions successively, the time-keeping means sequentially keeping time using, as a basic time unit, a time taken for the predetermined number of virtual particles to make a single travel from one of the space regions to the other space region, and an accumulating means for sequentially accumulating the time sequentially kept by the time-keeping section over a preset time period beginning at designated date and time and ending at a designated future time point so as to provide current elapsed time from the beginning point of the preset time period.

In the software-driven time measuring device according to the first aspect, the time-keeping section is programmed in such a manner that a predetermined number of virtual particles are caused to reciprocatively move between two virtual space regions successively, and the time-keeping section can sequentially keep time with accuracy using, as a basic time unit, a time required for the predetermined number of virtual particles to make a single travel from one of the space regions to the other space region. With the time values yielded by the time-keeping section, it is allowed to accurately accumulate the basic time unit over a preset time period (e.g., time data for 1,000 years). By incorporating such a time measuring device in each selected computer, common time can be set for shared use among computers connected in a network and also with a computer loaded in an artificial satellite operating far from the earth. In addition, communication among the computers and remote control of any of the computers can be performed very smoothly.

A software-driven time measuring device according to a second aspect of the invention comprises a time-keeping section provided in a central processing unit of a computer and including two virtual space regions having a same shape and capacity and isolated from other space region, the two virtual space regions being interconnected for communication therebetween in such a manner that a predetermined number of virtual particles are caused to reciprocatively move between the space regions successively, the time-keeping section sequentially keeping time using, as a basic time unit, a time taken for the predetermined number of virtual particles to make a single travel from one of the space regions to the other space region, an accumulating section for sequentially accumulating the time sequentially kept by the time-keeping section over a preset time period beginning at designated data and time and ending at a designated future time point so as to provide current elapsed time from the beginning point of the preset time period, a storage section for prestoring standard date and time of a plurality of countries on the earth that correspond to the beginning and ending points of the preset time period, a converting section for converting current elapsed time at a desired time point provided by the accumulating section into current standard date and time of a designated one of the countries on the basis of the standard date and time of the designated country prestored in the storage section so that the elapsed time having been converted into the current standard date and time is displayed on a display device, and a control section for allowing a human operator to access current elapsed time at any desired time point by inputting current standard date and time of a designated one of the countries by, in response to accessing by the human operator at the desired time point, causing the converting section to convert the inputted current standard date and time into corresponding time accumulated by the accumulating section.

In the software-driven time measuring device according to) the second aspect, a section is provided, in addition to the time-keeping section and accumulating section, for achieve a correspondence between the computer's measured time (elapsed time) and the country-specific standard date and time used on the earth by a human operator of each country. Thus, the computer operator can smoothly access the elapsed time measured in the central processing unit on the basis of the standard date and time of the country which the operator belongs to.

Further, a software-driven time measuring device according to a third aspect of the invention comprises a time-keeping section provided in a central processing unit of a computer and including two virtual space regions having a same shape and capacity and isolated from other space region, the two virtual space regions being interconnected for communication therebetween in such a manner that a predetermined number of virtual particles are caused to reciprocatively move between the space regions successively, the time-keeping section sequentially keeping time using, as a basic time unit, a time taken for the predetermined number of virtual particles to make a single travel from one of the space regions to the other space region, an accumulating section for sequentially accumulating the time sequentially kept by the time-keeping section over a preset time period beginning at designated data and time and ending at a designated future time point, so as to provide current elapsed time from the beginning point of the preset time period, a first storage section for prestoring standard date and time of a plurality of countries on the earth that correspond to the beginning and ending points of the preset time period, a converting section for converting current elapsed time at a desired time point provided by the accumulating section into current standard date and time of a designated one of the countries on the basis of the standard date and time of the designated country prestored in the storage section so that the current elapsed time converted into the current standard date and time is displayed on a display device, and a control section for allowing a human operator to access current elapsed time at any desired time point by inputting current standard date and time of a designated one of the countries, and for, in response to accessing by the human operator at the desired time point, causing the converting section to convert the inputted current standard date and time into corresponding time accumulated by the accumulating section, a second storage section for prestoring moving states of heavenly bodies including sunrise and sunset time and waxing and waning state of the moon corresponding to each individual elapsed time in selected places on the earth, and a display control section for causing the moving states of heavenly bodies to be displayed on the display device in correspondence with current elapsed time provided by the accumulating section.

The software-driven time measuring device according to the third aspect can display the time of sunrise and sunset, moving state of the sun, waxing and waning and moving state of the moon, and movement of various constellations in each of the selected countries in corresponding relations to the current elapsed time. Thus, the time measuring device can be a useful timepiece for outdoor activities and survival purposes, as well as for use in aircrafts and ships.

BRIEF DESCRIPTION OF THE ACCOMPANYING DRAWINGS

The above and other objects and advantages of the present invention will become apparent from the following detailed description of the preferred embodiments when read in conjunction with the accompanying drawings, in which.

DETAILED DESCRIPTION OF THE PREFERRED EMBODIMENTS

Figure 4:
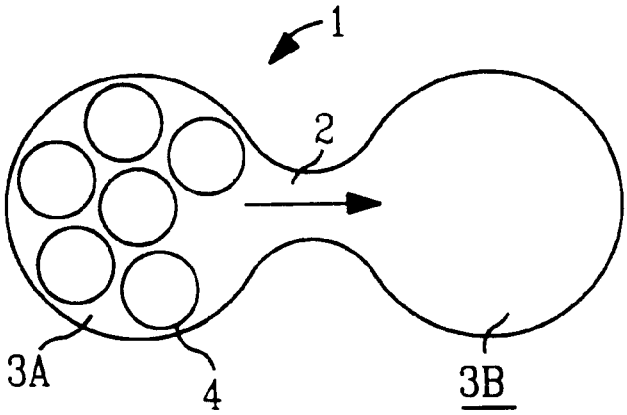
FIG. 4 is a diagram illustrating the general principle of a virtual time-measuring section in the time measuring device of FIG. 1.

Referring first to FIG. 4, there is shown a conceptual diagram of the operational principle of a -time-keeping section 1 constituting the present invention, which includes a pair of left and right virtual space regions 3A and 3B interconnected via a central communicating portion 2. The left and right virtual space regions 3A and 3B have exactly the same shape and capacity so as to provide a symmetricel arrangement with respect to the communicating portion 2 and are isolated from other space regions. An arbitrary number (six in the conceptual diagram of FIG. 4) of virtual particles 4 are caused to successively move, one at a time, through the communicating portion 2 from one of the virtual space regions 3A or 3B to the other 3B or 3A with the direction of the particle movement being reversed each time all the particles 4 are completely moved from one of the virtual space regions 3A or 3B to the other 3B or 3A. That is, after all the six virtual particles 4 have been moved from the left virtual space region 3A to the right virtual space region 3B, they are moved from the right region 3B to the left region 3A, then again from from the left region 3A to the right region 3B, and so on. The bidirectional or reciprocative movement of the virtual particles 4 between the space regions 3A and 3B is set to take place at constant time intervals, so that a lapse of time can be sequentially measured by using, as a basic time unit, the time taken for all the six particles 4 to make a single travel from one of the virtual space regions 3A or 3B to the other 3B or 3A.

Figure 5:
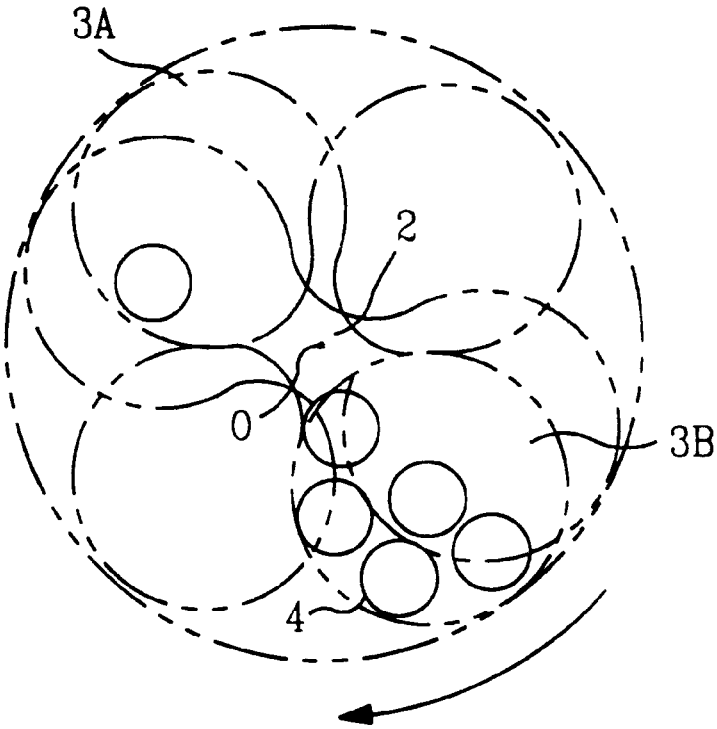
FIG. 5 is a diagram illustrating in more detail the time-measuring section rotating at a uniform speed.

In addition, such movements of the particles 4 between the space regions 3A and 3B permit more accurate time measurement if the symmetric space regions 3A and 3B are continuously rotated at a uniform speed in one direction about the center "O" of the communicating portion 2 so that the particles 4 are allowed to fall by gravity from the upper space region 3A or 3B to the lower space region 3B or 3A, as shown in FIG. 5. Specifically, by rotating the space regions 3A and 3B once (through 360°) about the center O, the six particles 4 are caused to reciprocate between the space regions 3A and 3B, generally as in the case where a sandglass or hourglass is rotated continuously.

Figure 6:
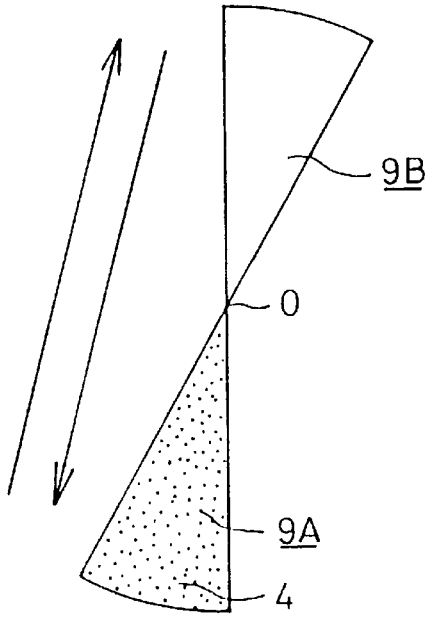
FIG. 6 is a diagram illustrating one of a plurality of measuring elements making up time-measuring section.
Figure 7:
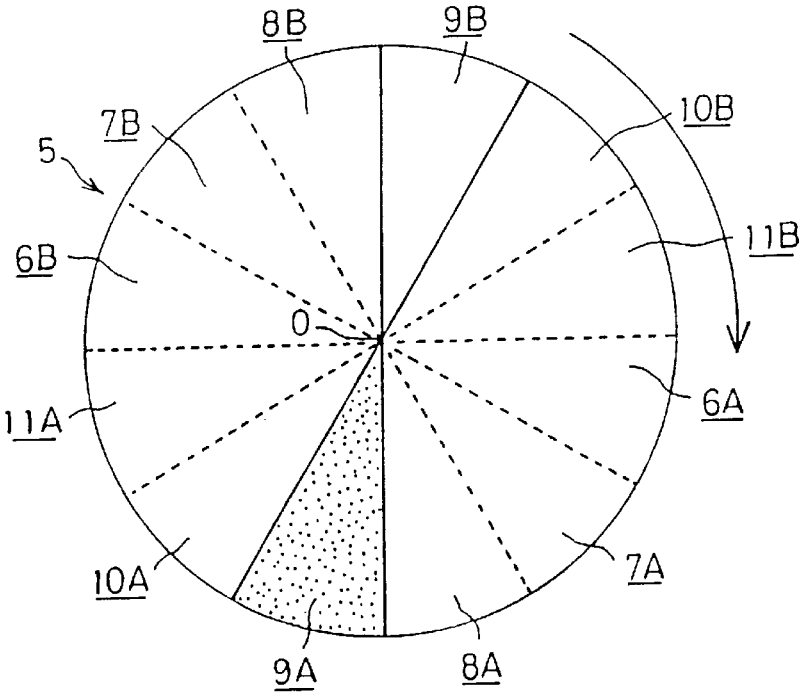
FIG. 7 is a diagram illustrating the entire time-measuring section.
Figure 8:
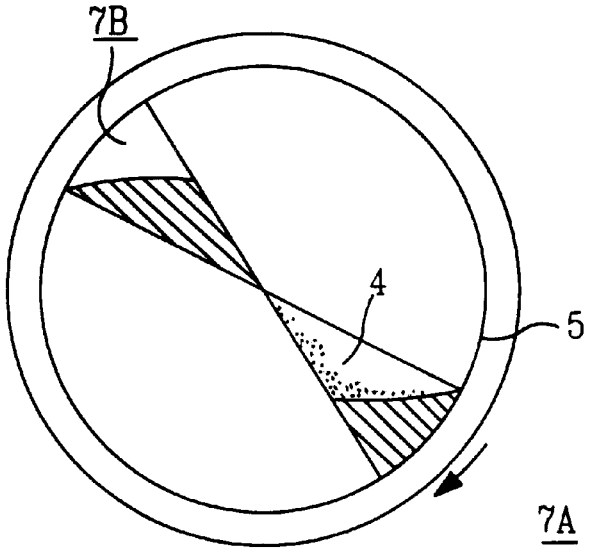
FIG. 8 is a diagram illustrating in more detail the measuring element rotating at a uniform speed.

The principle of the above-mentioned virtual time-keeping section rotating continuously will be described in more detail with reference to FIGS. 6 and 7. FIG. 7 shows a more detailed example of the virtual time-keeping section 5 which is generally in the form of a circle that is divided about the center O to 12 equal sectorial space regions so that the space regions are arranged symmetrically with respect to the center O; that is, the space regions 6A and 6B; 7A and 7B; 8A and 8B; 9A and 9B; 10A and 10B; and 11A and 11B are interconnected symmetrically in communication with each other with respect to the center O functioning as the communicating portion. Of the symmetrically arranged space regions in FIG. 7, the lower space regions 6A, 7A, 8A, 9A, 10A and 11A are filled with a predetermined number of the virtual particles 4 as representatively shown in FIG. 6. By rotating the thus-arranged circular time-keeping section 5 at a uniform speed in the arrowed direction in FIG. 7, the particles 4 are allowed to reciprocate between each pair of the symmetrical sectorial space regions as representatively shown in FIG. 6 (one reciprocative movement per rotation). That is, as representatively shown in FIG. 8, the rotation of the virtual time-keeping section 5 causes the particles 4 in the upper space region 7B in FIG. 8 to fall to the corresponding lower space region 7A, and such a movement of the particles 4 takes place sequentially between each pair of the space regions as the time-keeping section 5 rotates in the arrowed direction.

Figure 9:
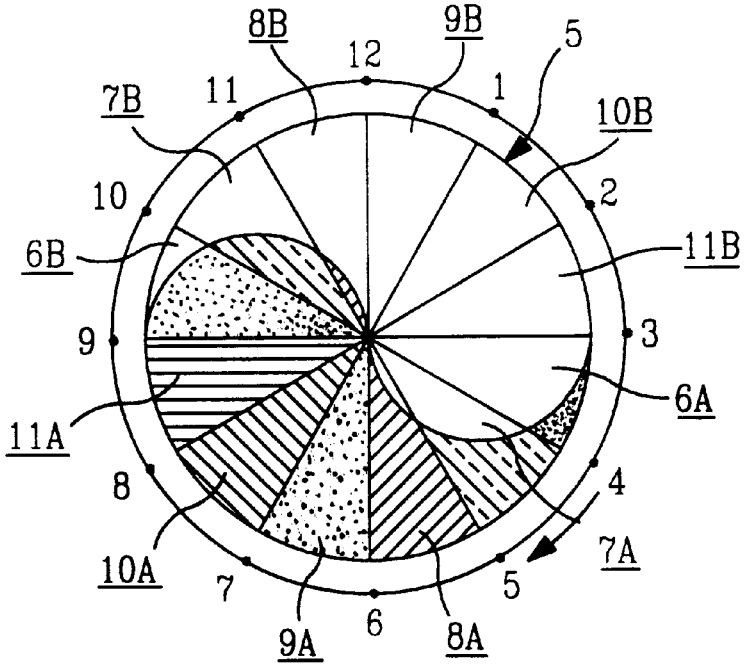
FIG. 9 is a diagram illustrating how the virtual time-measuring section in an operating state is displayed on a display.
Figure 10:
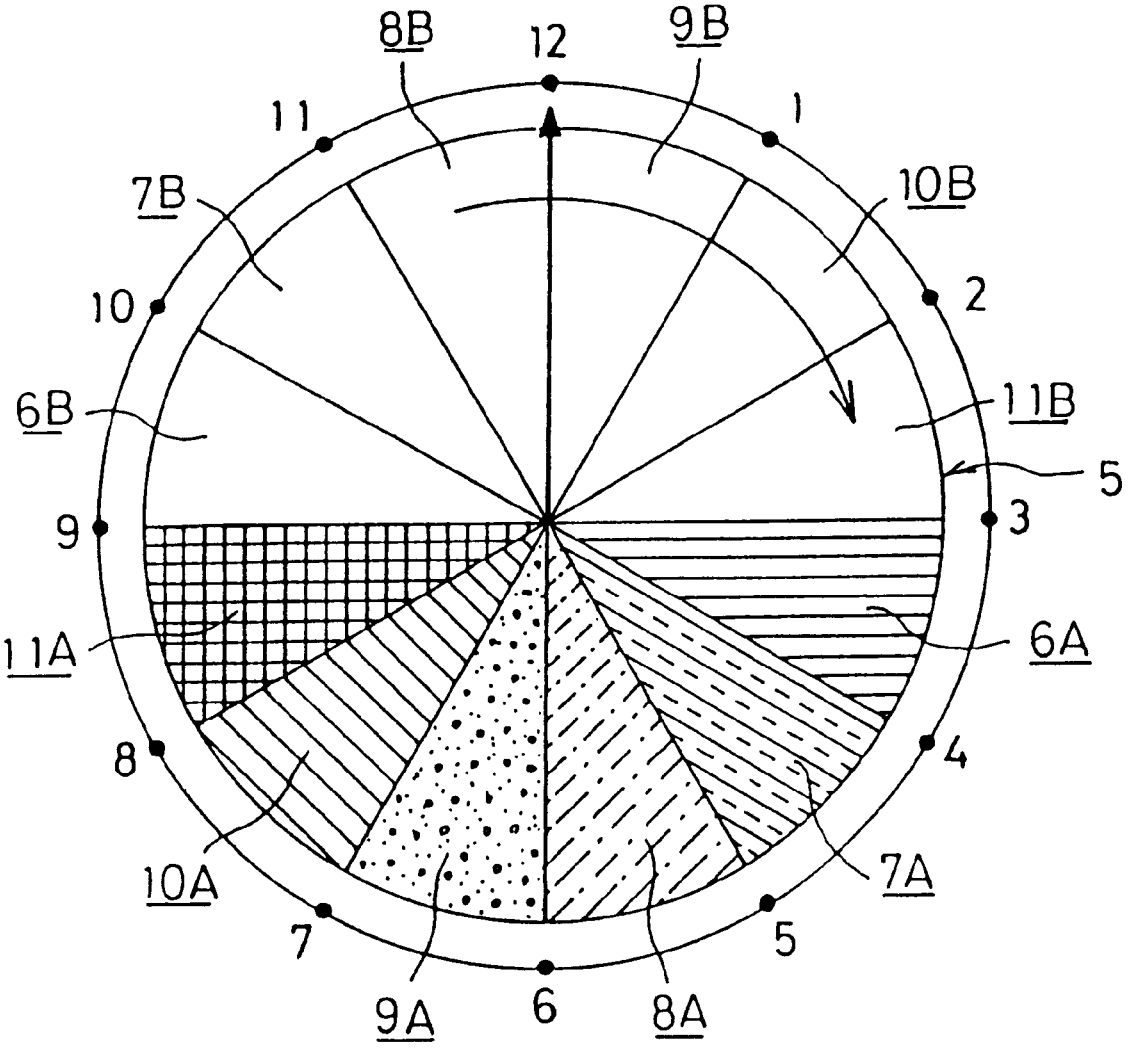
FIG. 10 is a diagram illustrating the virtual time-measuring section in a non-operating state is displayed on the display.
Figure 11:
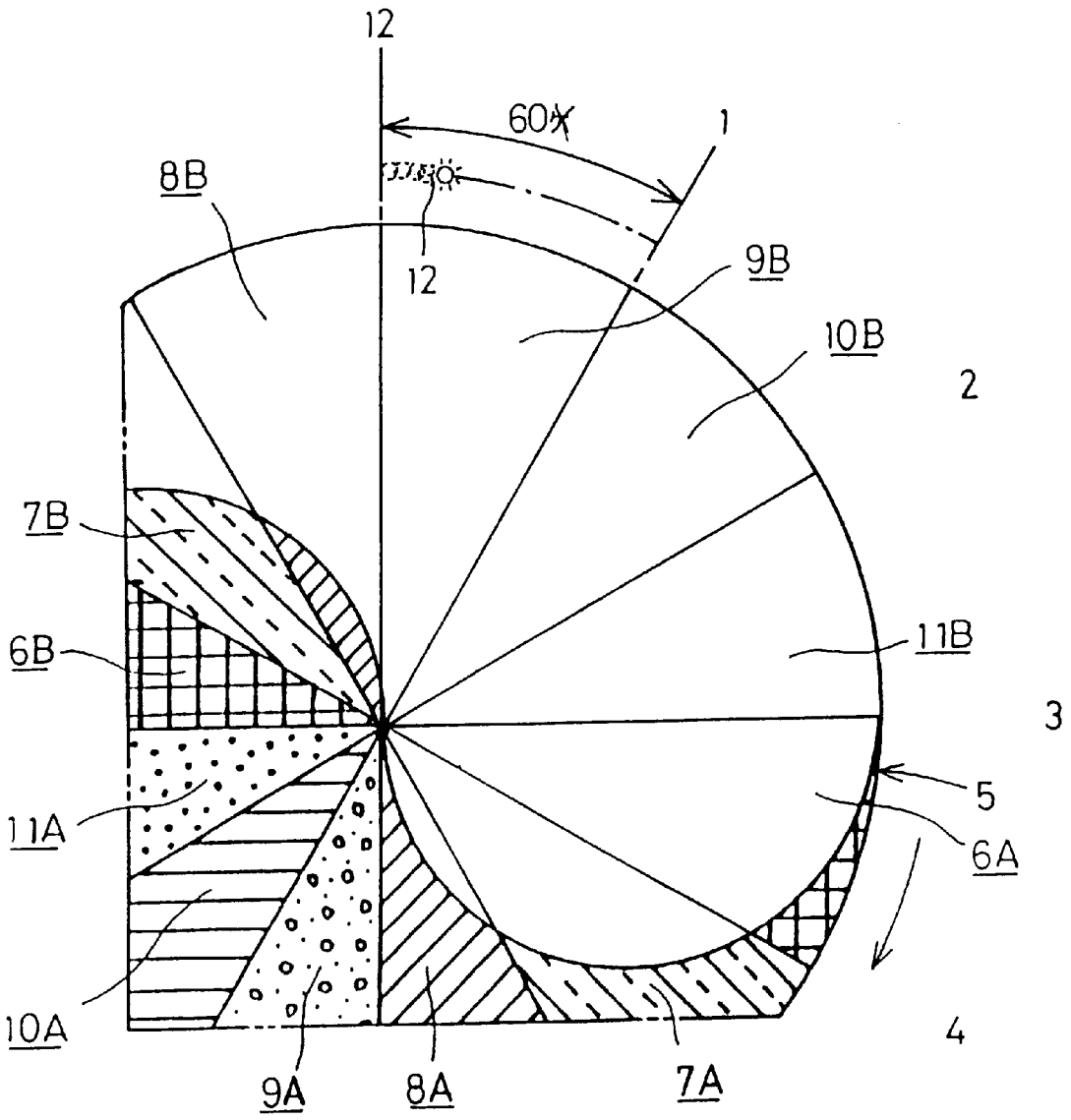
FIG. 11 is a diagram illustrating a part of FIG. 9 in enlarged scale.

For convenience of description about the present embodiment, it is now assumed that the circular time-keeping section 5 shown in FIG. 9 is set to make one rotation in 12 hours and the number of virtual particles 4 moving between the space regions is 3,600. Time graduations from "1" to "12" are disposed equidistantly along the outer periphery of the rotating time-keeping section 5 as shown in FIG. 10, and 60 display elements are disposed equidistantly between every two adjacent time graduations as shown in FIG. 11, so that one of the display elements 12 is lit each time 60 virtual particles 4 have been moved from one of the upper space regions (6B–8B in FIG. 11) to the corresponding lower space regions (6A–8A in FIG. 11). Thus, as the virtual time-keeping section 5 rotates in the arrowed direction, the display elements 12 are sequentially lit, one by one, in the clockwise direction (see FIG. 12). All the display elements 12 are lit in 12 hours. By programming the thus-arranged virtual time-keeping section 5 so as to be executed by a CPU of a computer and displaying it on the display such as a CRT (Cathode Ray Tube) or LCD (Liquid Crystal Display), the sequential moving lighting of the display element 12 relative to the time graduations can provide an analog time measuring device. In other words, because one display element 12 is lit every 60 seconds and the sequential moving lighting of the display element 12 virtually functions as an analog indicator to the time graduations, passage of minutes can be readily recognized from a pattern shown on the display. Further, because 60 particles 4 are caused to fall every minute, passage of seconds can also be readily recognized from a pattern shown on the display.

Figure 1:
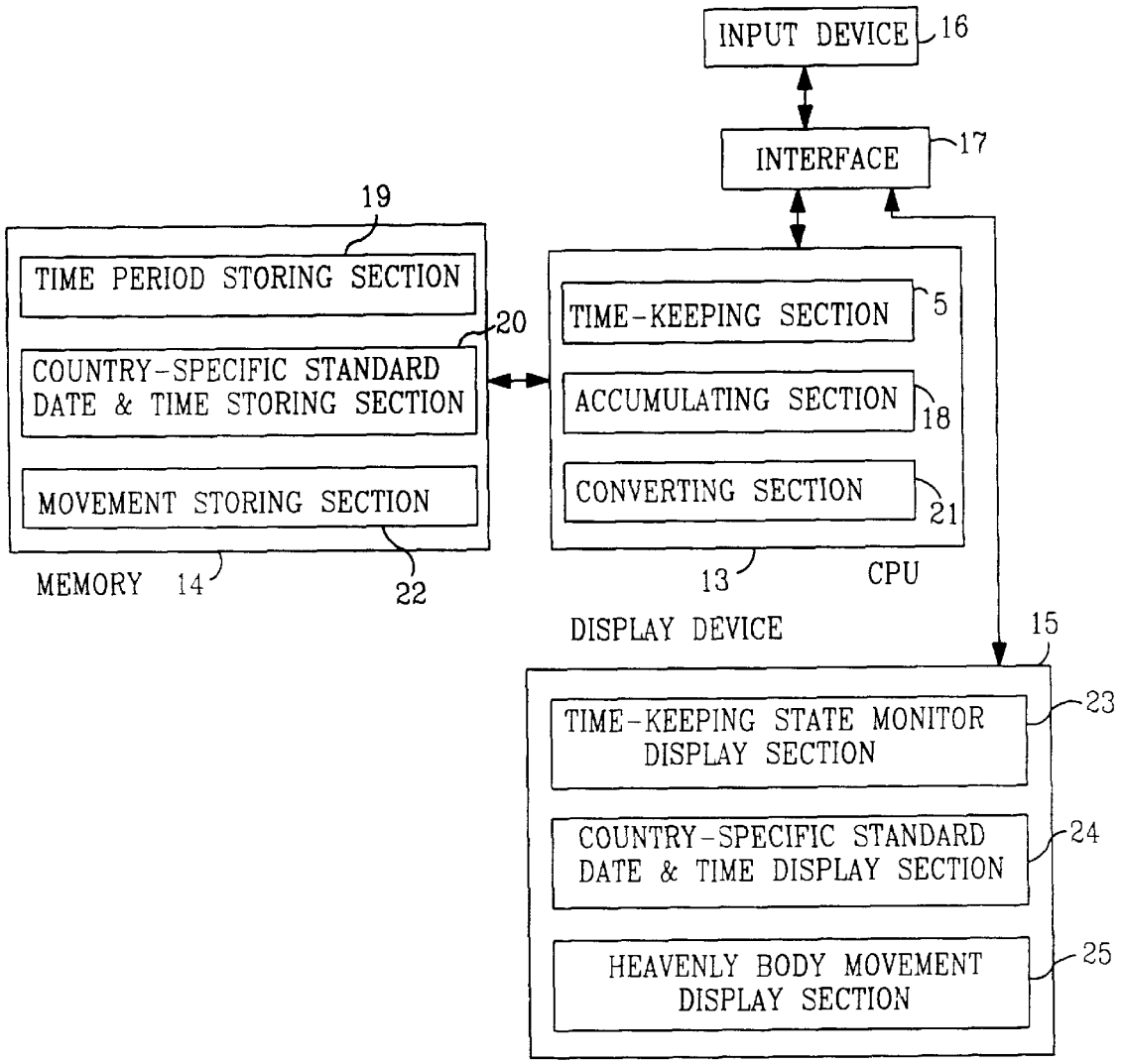
FIG. 1 is a block diagram illustrating a time measuring device in accordance with an embodiment of the present invention.

Now, with reference to FIGS. 1 and 2, a detailed description will be given hereinbelow on an embodiment of the time measuring device arranged in the above-mentioned manner. This time measuring device comprises CPU 13, memory 14, display device 15, input device 16 and interface 17. The CPU 13 contains a virtual time-keeping section 5 similar to the section 5 of FIG. 9, which is in the form of a circle that is divided to 12 sectors having the same shape and capacity so as to provide six pairs of symmetrical space regions or sectors 6A and 6B; 7A and 7B; 8A and 8B; 9A and 9B; 10A and 10B; and 11A and 11B. By rotating this circular virtual time-keeping section 5 at a uniform speed such that it makes one rotation in 12 hours, a predetermined number of virtual particles 4 from each of the upper virtual space regions (6B–8B in FIG. 11) of the rotating measuring section 5 to the corresponding lower virtual space region (6A–8A in FIG. 11).

More specifically, the virtual time-keeping section 5 is arranged in such a manner that one rotation of the section 5 causes 43,200 particles to sequentially fall from the upper virtual space regions of the rotating measuring section 5 to the corresponding lower virtual space regions; that is, one particle 4 is caused to fall from one of the upper regions to the corresponding lower region per second (see FIG. 12) arid thus the minimum or basic time unit, second, is measured by the falling of each particle 4. Each time value thus measured on the basis of the minimum time unit (second) is sequentially accumulated by an accumulating section 18 contained in the CPU 13. The accumulating section 18 accumulates the measured time values over a predetermined time period that begins with a preset date and time and ends with a given future time point. In the illustrated embodiment, the accumulating section 18 is set to sequentially accumulate measured seconds over a preset time measuring period of 1,000 years, and the beginning and ending points of the period are stored in a time period storing section 19 of memory 14. The beginning and ending points may be standardized for all computers to be manufactured, and 0:00 a.m., Jan. 1, 1995 and 0:00 a.m., Jan. 1, 2996 according to Greenwich Mean Time may be prestored in the storing section 19 as the beginning arid ending points, respectively. In other words, the presetting of the time measuring period is essential for setting a common time standard to be shared among a plurality of computers as will be later described. The embodiment permits a common time recognition among the computers by standardizing, as a finite time period, accumulated seconds for the 1,000 years. The time measuring period may be 10,000 years or more instead of 1,000 years, and in some cases, every 1,000 years may be sequentially accumulated as a "network year" with the time measuring period renewed every 1,000 years.

The memory 14 also includes a country-specific standard date and time storing section 20 prestoring standard date and time of selected principal countries of the world in corresponding relations to individual accumulated time values in the time measuring period. According to this embodiments the standard date and time of the selected principal countries may be those in Tokyo, London, Paris, New York, Hong Kong, Sydney, etc. based on the Gregorian calendar. The storing section 20 prestores the country-specific standard time in seconds, in corresponding relations to individual values of time passing from the beginning point of 0:00 a.m., Jan. 1, 1995 (Greenwich Mean Time).

When a computer operator (user of each country) attempt to access current elapsed time provided by the accumulating section 18 via the input device 16, the interface 17 permits the operator to access using the current standard date and time of the country to which the operator belongs. Specifically, when the operator attempt to access current elapsed time by inputting the standard date and time of his or her own country, a time value corresponding to the inputted date and time is read out from the storing section 20 of the memory 14, and current elapsed time yielded by the accumulating section 18 can be accessed at any desired point using the read-out time value.

Further, the memory 14 includes a movement storing section 22 which stores respective movements of the heavenly bodies over the above-mentioned principal cities, such as sunrise and sunset, and waxing and waning of the moon, in corresponding relations to the individual time values or elapsed time provided by the accumulating section 18.

Figure 12:
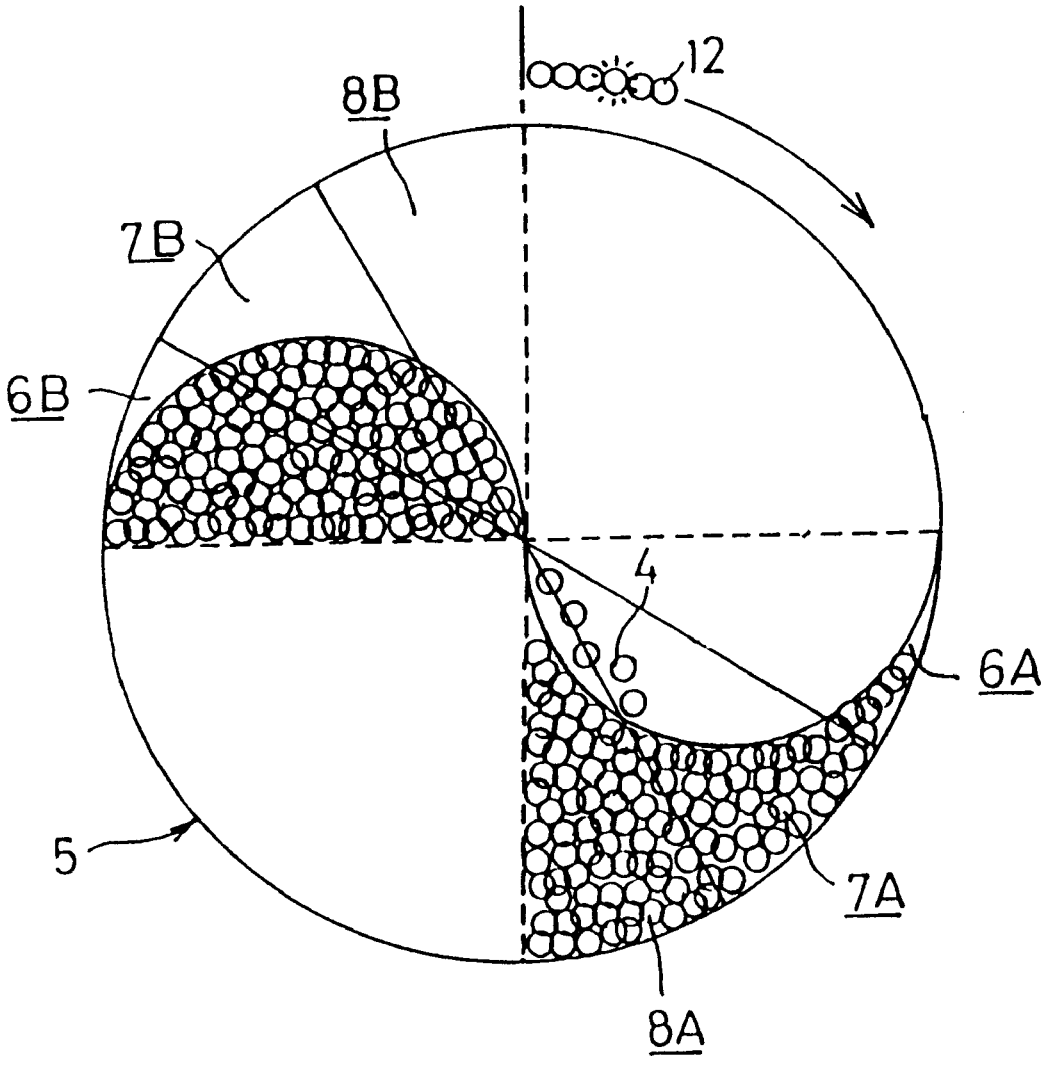
FIG. 12 is a diagram similar to FIG. 11, illustrating how time particles move from upper virtual space regions to lower virtual space regions.

The display device 15, which may be a CRT or LCD, includes a display section 23 for monitoring a current time-keeping state, a display section 24 for displaying the country-specific standard date and time, and a display section 25 for displaying the movements of the heavenly bodies such as the sun and moon. More specifically, the time-keeping state monitoring display section 23 displays on a screen of the display device 15 the time-keeping section 5 of FIG. 9, and it visually presents, in analog form, passage of the second by the falling of the particles 4 as shown in FIG. 12 (monitoring of the minimum time unit) and passage of the minute and hour by sequential moving lighting of the display element 12 relative to the time graduations from "1" to "12". Such display of the time-keeping state is enabled by selecting a "time-keeping state monitor" mode on the input device 16.

Figure 2:
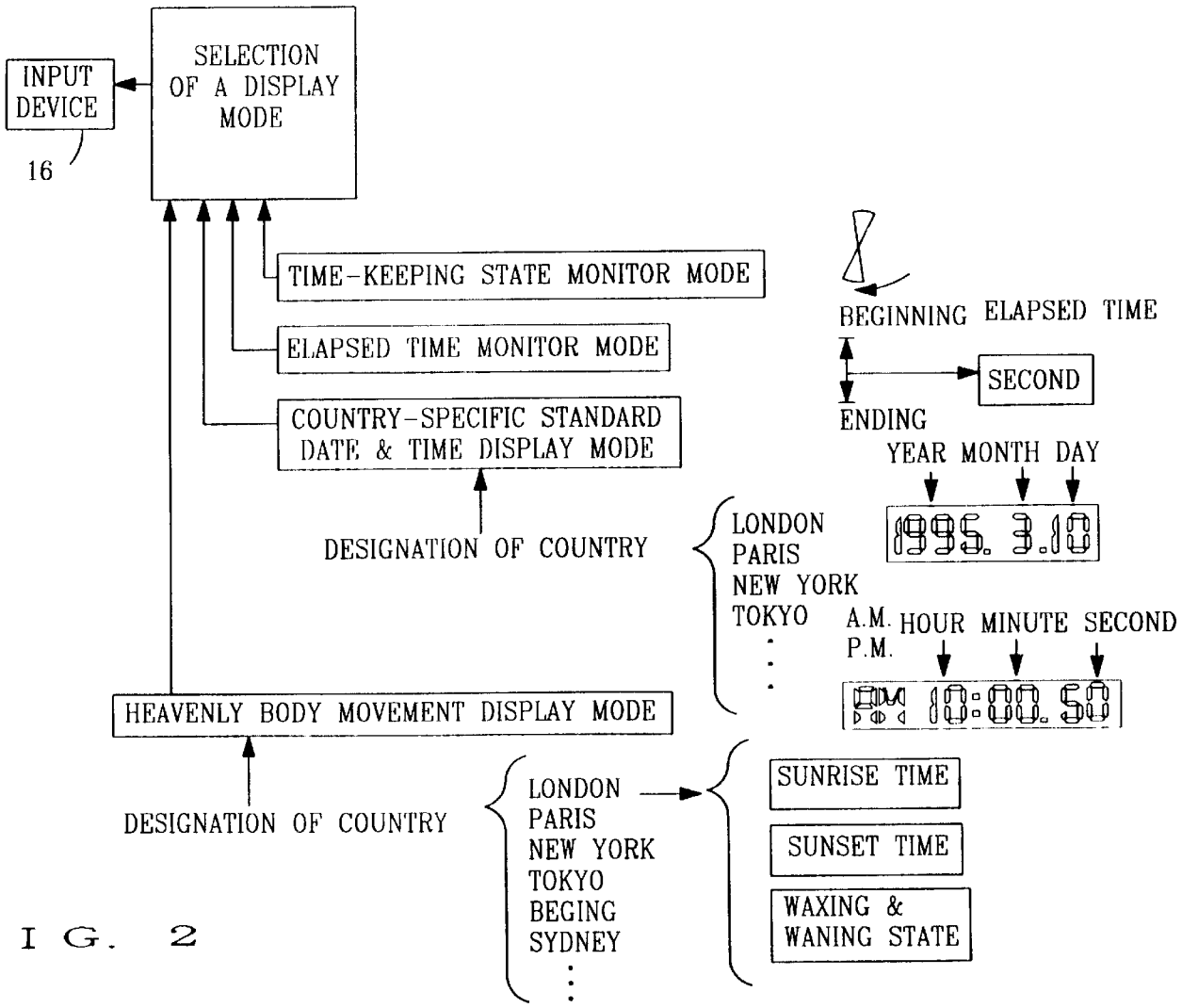
FIG. 2 is a block diagram explanatory of display mode switching by an input device of FIG. 1.

When an "elapsed time monitor" mode is selected On the input device 16, the display device 15 presents, in digital form, elapsed time accumulated by the accumulating section 18 of the CPU 13, as exemplarily shown in FIG. 2 at "xxxx second". Further, by selecting a "country-specific standard date and time display" mode and designating any one of the countries, the display device 15 is caused to present, in digital form, the standard date and time of the designated country based on the Gregorian calendar (see FIG. 2). Such values to be displayed are obtained by a converting section 21 converting the data stored in the country-specific standard date and time storing section 20 on the basis of the current elapsed time provided by the accumulating section 18, and the values thus obtained are presented on the display screen via the interface 17.

Figure 13:
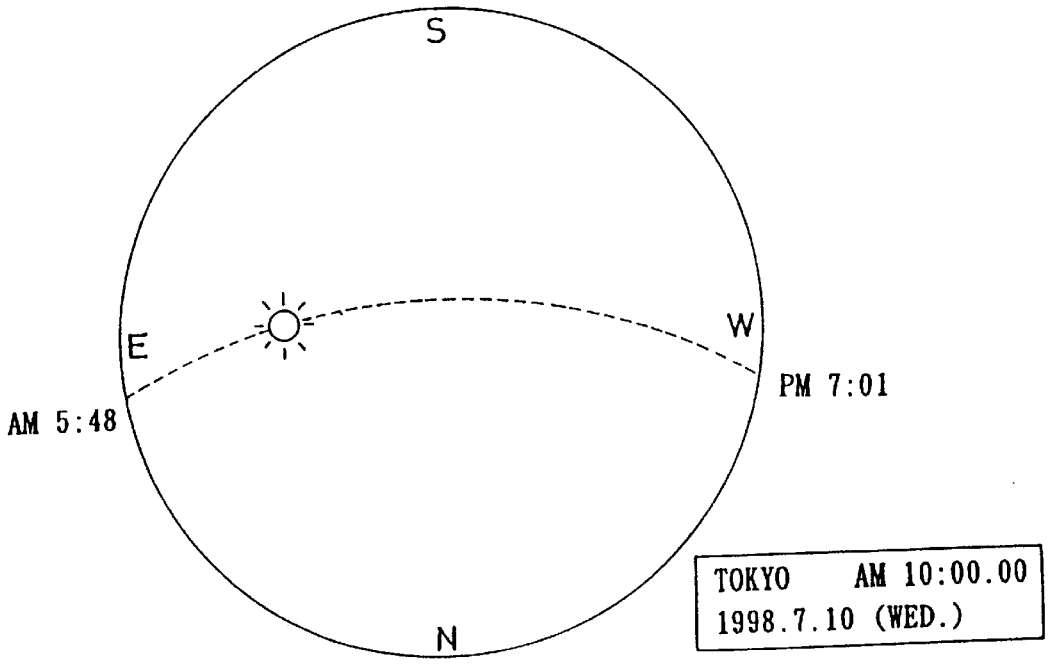
FIG. 13 is a diagram showing a display screen displaying sunrise and sunset time and moving state of the sun when a heavenly body monitor mode is selected.
Figure 14:
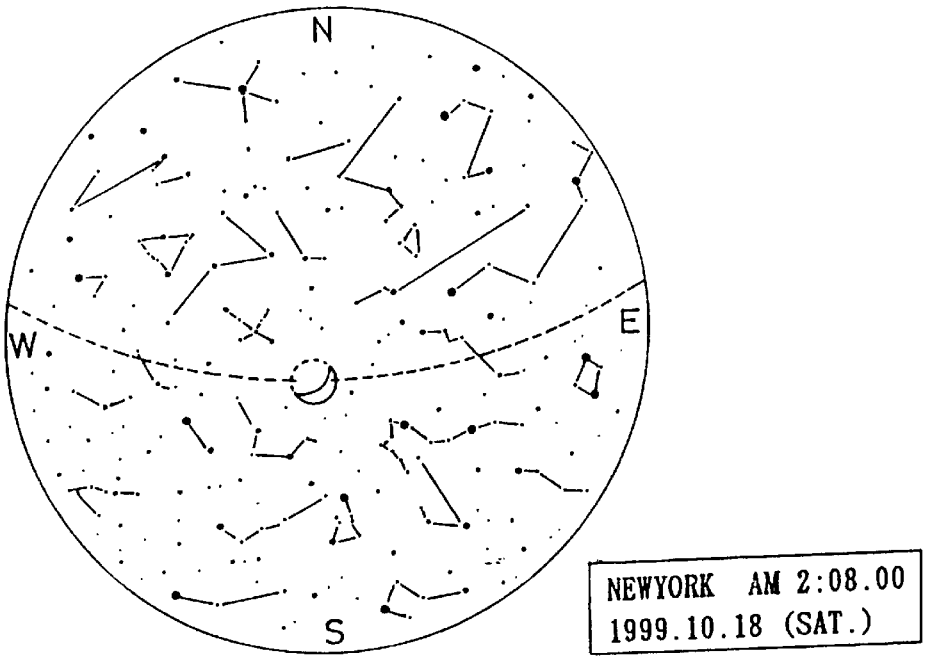
FIG. 14 is a diagram showing the display screen displaying a waxing and waning state of the moon and moving states of the moon and constellations.

In response to selection of a "heavenly body monitor" mode and designation of any one of the countries on the input device 16, the above-mentioned display section 25 is caused to present on the display screen current movement states of the heavenly bodies for the designated countries. Such display is achieved by the converting section 21 successively converting the data stored in the movement storing section 22 on the basis of the current elapsed time provided by the accumulating section 18 and sending the converted data to the display device 15 by way of the interface 17. As shown in FIGS. 13 and 14, these data are graphically displayed on the display screen within a circle representing the sky, along with the standard date and time of the designated country (right bottom of the figures); for the daytime zone, the sun is also displayed, within the sky-representing circle, as time-varying its position along its orbit together with the time of sunrise and sunset, as shown in FIG. 13. In contrast, for the night-time zone, the moon in the waxing or waning state corresponding to the current date and time is displayed, within the sky-representing circle, as time-varying its position along its orbit together with graphic presentation of moving states of constellations. Alphabets "E", "W", "S" and "N" are also included in the graphic display of the sky to indicate the east, west, south and north, respectively.

Figure 3:
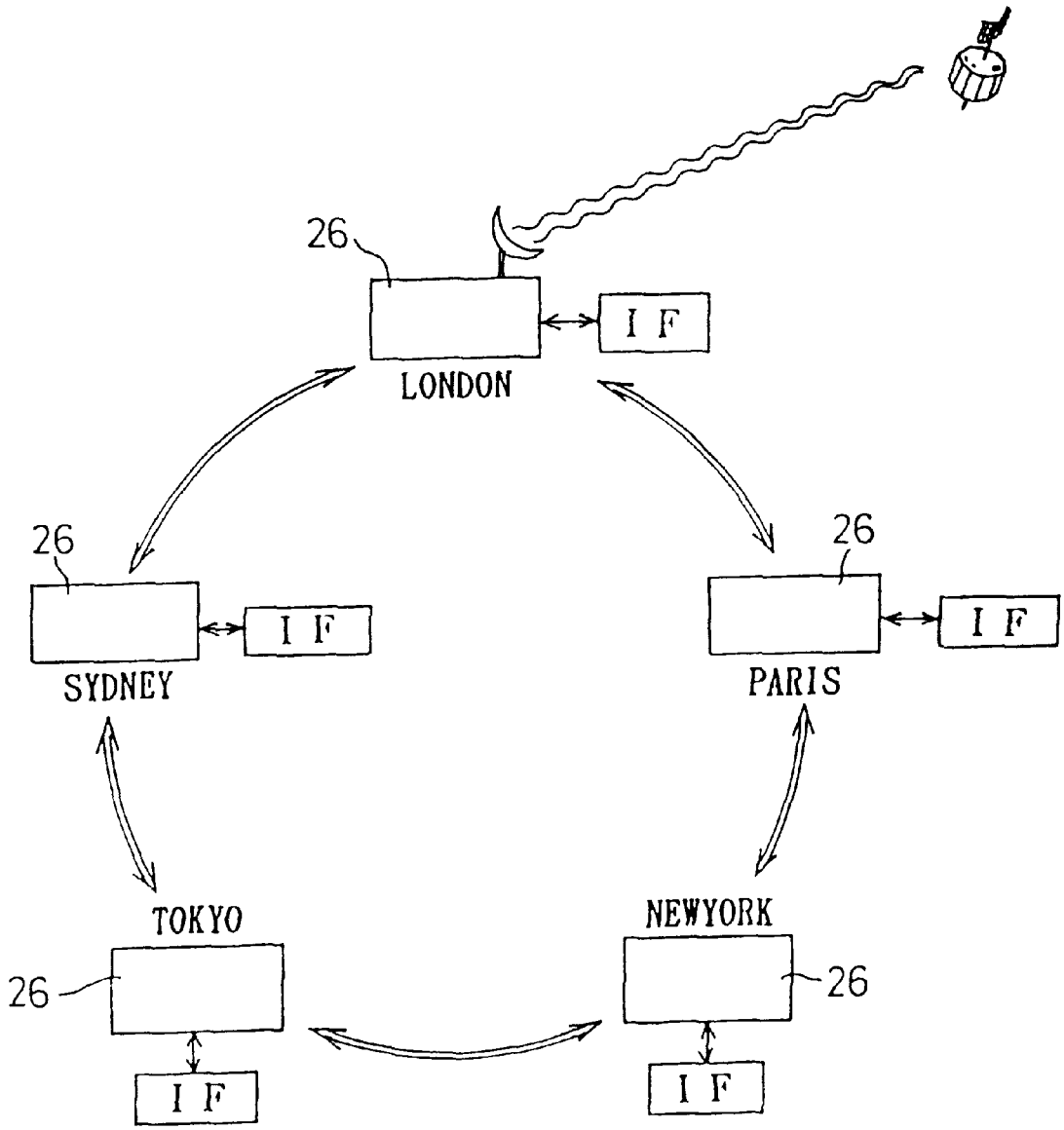
FIG. 3 is a block diagram illustrating a computer network using the time measuring device of the present invention.

A computer containing the software-driven time measuring device constructed in the above-described manner is also well suited for use in network communication among a plurality of similar computers 26 and in communication with a computer loaded into an artificial satellite as shown in FIG. 3, because the time measuring device provides a common time concept, i.e., elapsed time from the beginning point of the preset time period, thus facilitating sequential access. Also, each of the computers 26 is provided with an interface corresponding to the standard time of the country where the computer 26 is located. Particularly, in launching artificial satellites, uniformized time management can be conducted on the basis of the same time standard, as compared to the conventional technique where different time management had to be conducted on each satellite on the basis of the lift-off time (so-called "countdown time") of the satellite.

As mentioned earlier in connection with the "Description of Related Art", a leap second occurs once in some years in Universal Time or each country's standard time. However, the time measuring device in accordance with the embodiment can rectify the leap year by performing an amendatory operation to just adjust, by one second, the stored standard date and time in the country-specific standard date and time storing section 20 of the memory 14, without a need to operate any of the time-keeping section 5, accumulating section 18 and converting section 21 of the CPU 13. Consequently, the accumulating section 18 of the CPU 13 is allowed to yield elapsed time independently of the other sections, and a common time concept will be maintained in all the individual computers 26 of FIG. 3.

According to the above-described embodiment, the time-keeping section 5 is provided in the CPU 13 of a computer and is in the form of a circle that is divided into 12 equal sectors so as to provide six pairs of symmetrical virtual space regions 6A and 6B; 7A and 7B; 8A and 8B; 9A and 9B; 10A and 10B; and 11A and 11B. 3,600 virtual particles 4 are allowed to successively reciprocate between each pair of the symmetrical virtual space regions. With the time values yielded by the time-keeping section 5, it is allowed to sequentially accumulate time over a preset time period (e.g., time data for 1,000 years). By incorporating such a time measuring device in each of the selected computers 26 as shown in FIG. 3, a common time standard can be set for shared use among computers connected in a network and also with a computer loaded in an artificial satellite which is far from the earth and hence has no relation to the earth's time standard or concept. In addition, communication among the computers and remote control of any of the computers can be performed very smoothly.

Further, because the above-described embodiment includes, in addition to the time-keeping section 5 and accumulating section 18, the interface 17 to achieve a correspondence between the computer's measured time and the country-specific standard date and time used on the earth by a human operator of each country, the computer operator can smoothly access the elapsed time measured in the CPU 13 on the basis of the standard date and time of the country which the operator belongs to.

Furthermore, the above-described embodiment allows the time-keeping section 5 of FIG. 9 to be visually monitored on the display device 15, by which it can display, in analog form, passage of the hour and minute by the sequential moving lighting of the display elements 12. Passage of the second or time-keeping state of the section 5 can also be displayed by the successive movement of the virtual particles 4.

Also, the above-described embodiment can display the time of sunrise and sunset, moving state of the sun, waxing and waning and moving state of the moon, and movement of various constellations in each of the selected countries in corresponding relations to the measured elapsed time or the standard date and time of the country. Thus, the present invention can provide a time measuring device as a useful timepiece for outdoor activity and survival purposes, as well as for use in aircrafts and ships.

Figure 15:
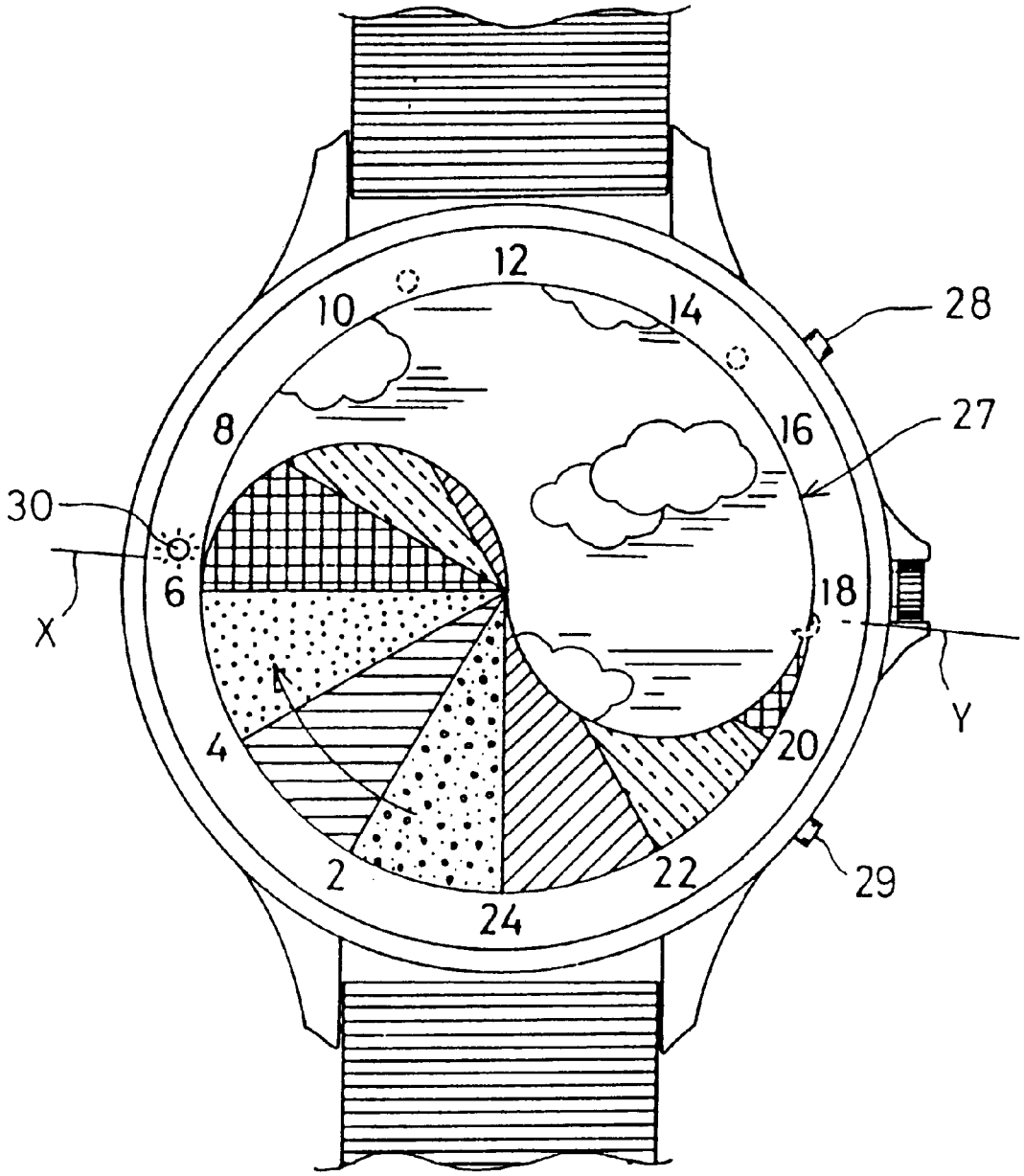
FIG. 15 is a diagram showing the time measuring device embodied as a wrist watch and its display screen displaying daytime conditions of the sky.
Figure 16:
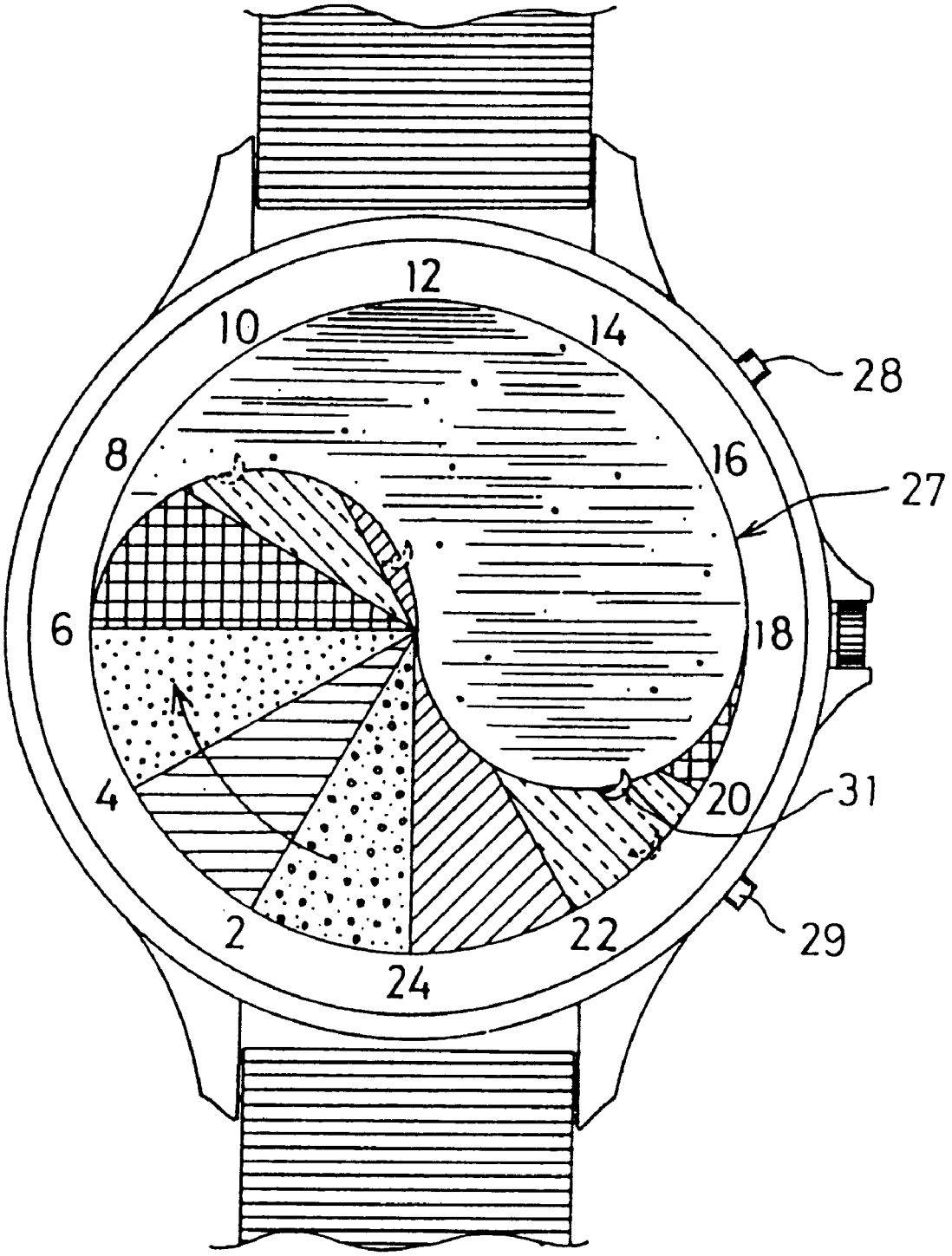
FIG. 16 is a diagram showing the display screen displaying nighttime conditions of the sky.

FIGS. 15 and 16 illustrate a wrist watch embodying the time measuring device according to the above-described embodiment. The illustrated wrist watch is characterized by being provide with a color LCD screen 27 having a generally circular shape, on which there can be shown various images corresponding to the display modes shown in FIG. 2. A desired display mode, i.e., desired image to be displayed on the screen 27 can be selected by actuating one of mode selection switches 28 and 29 provided on the outer periphery of the watch. When the elapsed time monitor mode is selected, a time-keeping section similar to that of FIG. 9 is displayed on the entire area of the circular screen. Whereas the time-keeping section 5 of FIG. 9 has 12 time graduations from "1" to "12" and makes one rotation in 12 hours, the wrist watch of the figures has 12 time graduations from "2" to "24" and makes one rotation in 24 hours.

In the elapsed time monitor mode, current elapsed time provided by the accumulating section 18 is displayed in digital form on the central part of the display screen 27, for example, as "xxxx second". Further, in the country-specific standard date and time display mode, current standard date and time of a designated country (city) is displayed accurately up to the second in digital form as shown in FIG. 2, on the central part of the display screen 27.

Further, in the heavenly body monitor mode, states of the heavenly bodies over a designated country can be displayed on the screen 27 as shown in FIG. 13 or 14. Specifically, if the designated country is currently in the daylight hours, the moving state of the sun is displayed on the screen 27 in FIG. 13, while if the designated country is currently in the night hours, the waxing and waning and moving states of the moon as well as the moving states of various constellations are displayed on the screen 27.

In addition, the wrist watch of FIGS. 15 and 16 in the normal mode displays current time of a designated city in analog form. For the analog display of the current time, the time graduation is provided for every two hours along the outer periphery of the screen 27, and space regions moving in the arrowed direction are displayed on the lower part of the screen 27. On the upper part of the screen 27, a state of the sky representing the daytime is displayed in color when the designated country is in the daylight hours as shown in FIG. 15, but a state of the sky representing the nighttime is displayed in color when the designated country is in the non-daylight hours as shown in FIG. 16. Alternatively, the sky state of FIG. 14 may be displayed on the screen 27 when the designated country is in the non-daylight hours.

An indicator 30 is provided to move between the time graduations in a similar manner to the display element 12 of FIG. 11. In the daylight hours, the indicator 30 is displayed to move between the upper time graduations so as to represent the moving sun (FIG. 15); that is, the indicator 30 is caused to appear at the sunrise time (X point) and move between the time graduations until the sunset time (Y point). In the non-daylight hours, another indicator 31 designed to represent the moving moon is caused to move along a wave-shaped boundary between the upper and lower parts of the screen 27. In the embodiment, the indicator 31 is caused to appear only in the non-daylight hours and represents a waxing and waning state of the current date and time.

The wrist watch arranged in the above-mentioned manner permits instant and accurate recognition of the current time, daylight hours, waxing and waning state of the moon, etc. in response to a selection of any of the display modes and countries, and can be used in a variety of applications as a useful timepiece for outdoor activities and survival purposes. In addition, the wrist watch may prove its utility in multimedia applications because every wrist watch thus arranged can share a common accurate time standard.

As has been described so far in connection with the preferred embodiments, the software-driven time measuring device of the present invention can provide time measurement with maximized accuracy.

What is claimed is:

1. A software-driven time measuring device comprising:

time-keeping means provided in a central processing unit of a computer and including two virtual space regions having a same shape and capacity and isolated from other space region, said two virtual space regions being interconnected for communication therebetween in such a manner that a predetermined number of virtual particles are caused to reciprocatively move between said space regions successively, said time-keeping means sequentially keeping time using, as a basic time unit, a time taken for said predetermined number of virtual particles to make a single travel from one of said space regions to another said space region; and accumulating means for sequentially accumulating the time sequentially kept by said time-keeping means over a preset time period beginning at designated date and time and ending at a designated future time point, so as to provide current elapsed time from a beginning point of said preset time period.

2. A software-driven time measuring device comprising:

time-keeping means provided in a central processing unit of a computer and including two virtual space regions having a same shape and capacity and isolated from other space region, said two virtual space regions being interconnected for communication therebetween in such a manner that a predetermined number of virtual particles are caused to reciprocatively move between said space regions successively, said time-keeping means sequentially keeping time using, as a basic time unit, a time taken for said predetermined number of virtual particles to make a single travel from one of said space regions to another said space region, wherein said two virtual space regions are symmetrical with respect to a central communicating portion, and said two virtual space regions are continuously rotated vertically in a single direction about said central communicating portion at a uniform speed in such a manner that the virtual particles are caused by gravity to move from one of said space regions through said communicating portion to another said space region while said one space region is located above said other space region, and then said other space region is rotated upwardly the moment all of the predetermined number of the virtual particles have moved from said one space region to said other space region so that the virtual particles are caused to move from said other space region to said one space region;

accumulating means for sequentially accumulating the time sequentially kept by said time-keeping means over a preset time period beginning at designated date and time and ending at a designated future time point, so as to provide current elapsed time from a beginning point of said preset time period; and a display device connected with said central processing unit wherein movement of the virtual particles between said two virtual space regions is presented on said display device so as to permit visual monitoring of the current elapsed time provided by said accumulating means.

3. A software-driven time measuring device as claimed in claim 2 further comprising:

storage means for prestoring standard date and time of a plurality of countries on the earth that correspond to the beginning and ending points of the preset time period;

converting means for converting current elapsed time at a desired time point provided by said accumulating means into current standard date and time of a designated one of the countries on the basis of the standard date and time of the designated country prestored in said storage means so that the elapsed time having been converted into the current standard date and time is displayed on said display device; and control means for allowing a human operator to access current elapsed time at any desired time point by inputting current standard date and time of a designated one of the countries by, in response to accessing by said human operator at the desired time point, causing said converting means to convert the inputted current standard date and time into corresponding time accumulated by said accumulating means.

4. A software-driven time measuring device as claimed in claim 3 further comprising:

second storage means for prestoring moving states of heavenly bodies including sunrise and sunset time and waxing and waning state of the moon corresponding to each individual elapsed time in selected places on the earth; and display control means for causing the moving states of heavenly bodies to be displayed on the display device in correspondence with current elapsed time provided by said accumulating means.

5. A software-driven time measuring device comprising:

time-keeping means provided in a central processing unit of a computer and including two virtual space regions having a same shape and capacity and isolated from other space region, said two virtual space regions being interconnected for communication therebetween in such a manner that a predetermined number of virtual particles are caused to reciprocatively move between said space regions successively, said time-keeping means sequentially keeping time using, as a basic time unit, a time taken for said predetermined number of virtual particles to make a single travel from one of the space regions to another said space region;

accumulating means for sequentially accumulating the time sequentially kept by said time-keeping means over a preset time period beginning at designated data and time and ending at a designated future time point, so as to provide current elapsed time from a beginning point of said preset time period;

storage means for prestoring standard date and time of a plurality of countries on the earth that correspond to the beginning and ending points of the preset time period;

converting means for converting current elapsed time at a desired time point provided by said accumulating means into current standard date and time of a designated one of the countries on the basis of the standard date and time of the designated country prestored in said storage means so that the elapsed time having been converted into the current standard date and time is displayed on a display device; and control means for allowing a human operator to access current elapsed time at any desired time point by inputting current standard date and time of a designated one of the countries by, in response to accessing by said human operator at the desired time point, causing said converting means to convert the inputted current standard date and time into corresponding time accumulated by said accumulating means.

6. A software-driven time measuring device comprising:

time-keeping means provided in a central processing unit of a computer and including two virtual space regions having a same shape and capacity and isolated from other space region, said two virtual space regions being interconnected for communication therebetween in such a manner that a predetermined number of virtual particles are caused to reciprocatively move between said space regions successively, said time-keeping means sequentially keeping time using, as a basic time unit, a time taken for said predetermined number of virtual particles to make a single travel from one of the space regions to another said space region;

accumulating means for sequentially accumulating the time sequentially kept by said time-keeping means over a preset time period beginning at designated data and time and ending at a designated future time point, so as to provide current elapsed time from a beginning point of said preset time period;

first storage means for prestoring standard date and time of a plurality of countries on the earth that correspond to the beginning and ending points of the preset time period;

converting means for converting current elapsed time at a desired time point provided by said accumulating means into current standard date and time of a designated one of the countries on the basis of the standard date and time of the designated country prestored in said storage means so that the current elapsed time converted into the current standard date and time is displayed on a display device; and control means for allowing a human operator to access current elapsed time at any desired time point by inputting current standard date and time of a designated one of the countries, and for, in response to accessing by said human operator at the desired time point, causing said converting means to convert the inputted current standard date and time into corresponding time accumulated by said accumulating means;

second storage means for prestoring moving states of heavenly bodies including sunrise and sunset time and waxing and waning state of the moon corresponding to each individual elapsed time in selected places on the earth; and display control means for causing the moving states of heavenly bodies to be displayed on the display device in correspondence with current elapsed time provided by said accumulating means.

7. A software-driven time measuring device comprising:

time-keeping means provided in a central processing unit of a computer and including two virtual space regions having a same shape and capacity and isolated from other space region, said two virtual space regions being interconnected for communication therebetween in such a manner that a predetermined number of virtual particles are caused to reciprocatively move between said space regions successively, said time-keeping means sequentially keeping time using, as a basic time unit, a time taken for said predetermined number of virtual particles to make a single travel from one of the space regions to another said space region;

accumulating means for sequentially accumulating the time sequentially kept by said time-keeping means over a preset time period beginning at designated date and time and ending at a designated future time point, so as to provide current elapsed time from a beginning point of said preset time period;

first storage means for prestoring standard date and time of a plurality of countries on the earth that correspond to the beginning and ending points of the preset time period:

a display device;

converting means for converting current elapsed time at a desired time point provided by said accumulating means into a desired time point provided by said accumulating means into current standard date and time of a designated one of the countries on the basis of the standard date and time of the designated country prestored in said storage means so that the current elapsed time converted into the current standard date and time is displayed on said display device; and control means for allowing a human operator to access current elapsed time at any desired time point by inputting current standard date and time of a designated one of the countries, and for, in response to accessing by said human operator at the desired time point, causing said converting means to convert the inputted current standard date and time into corresponding time accumulated by said accumulating means;

second storage means for prestoring moving states of heavenly bodies including sunrise and sunset time and waxing and waning state of the moon corresponding to each individual elapsed time in selected places on the earth;

display control means for causing the moving states of heavenly bodies to be displayed on said display device in correspondence with current elapsed time provided by said accumulating means;

wherein said display device has a display screen, time graduations provided at uniform intervals along an outer periphery of said screen and indicating every two hours of a whole day or every hour of a half day, and analog indicator means indicating current standard date and time of a designated one of the countries by being caused to move along the outer periphery of said screen at such a rate to make a single round in 24 or 12 hours.

8. A software-driven time measuring device as defined in claim 7 wherein said analog indicator means comprises an indicator which, in daylight hours from sunrise time to sunset time, represents the sun and is caused to circularly move along the outer periphery of said screen past the time graduations, but, in non-daylight hours from the sunset time to the sunrise time, represents the moon having a waxing and waning state corresponding to current date and time and circularly move along the outer periphery of said screen past the time graduations.

* * * * *